United States Patent [19]

Stumpp et al.

[11] 4,230,080

[45] Oct. 28, 1980

[54] DEVICE FOR EXHAUST GAS RECYCLING

[75] Inventors: Gerhard Stumpp, Stuttgart; Werner Banzhaf, Sindelfingen, both of Fed. Rep. of Germany

[73] Assignee: Robert Bosch GmbH, Stuttgart, Fed. Rep. of Germany

[21] Appl. No.: 42,267

[22] Filed: May 24, 1979

[30] Foreign Application Priority Data

May 31, 1978 [DE] Fed. Rep. of Germany ..... 2823671

[51] Int. Cl.[3] ..... F02M 25/06

[52] U.S. Cl. ..... 123/568

[58] Field of Search ..... 123/119 A

[56] References Cited

U.S. PATENT DOCUMENTS 4,031,873 6/1977 Banzhaf et al. ..... 123/119 A 4,043,304 8/1977 Stumpp et al. ..... 123/119 A

*Primary Examiner*—Wendell E. Burns

*Attorney, Agent, or Firm*—Edwin E. Greigg

[57] ABSTRACT

A device for exhaust gas recycling is proposed which controls the amount of recycled exhaust gas in an internal combustion engine equipped with an injection unit so that a certain air factor is attained. The device comprises a closing element for the exhaust gas return conduit, which latter terminates into the intake manifold, this closing element being suitably constituted by a throttle valve and being directly connected to the adjusting lever or control rod of the injection pump. If this connection is established via a resilient linkage between the adjusting lever and the exhaust gas return valve, then the thus-recycled amount of exhaust gas can be dimensioned so that a specific quantity of recycled exhaust gas is associated with a specific angular position of the adjusting lever.

9 Claims, 2 Drawing Figures

A°
50
40
30
20
10
0
0
10
20
30
40
α°
I
II
III
$n_{KW}$ =
1200 1/min
1600 1/min
2500 1/min
2800 1/min
3600 1/min
4200 1/min

DEVICE FOR EXHAUST GAS RECYCLING

BACKGROUND OF THE INVENTION

The invention relates to a device for exhaust gas recycling in internal combustion engines equipped with a fuel injection system of the type revealed hereinafter. Control devices which are arranged to determine the composition of the operating mixture of an internal combustion engine and also control the exhaust gas recycling so that a certain air factor is attained, are already known. The recycling of quantities of exhaust gas adapted to the respective operating condition of the internal combustion engine represents an effective measure for reducing environmentally harmful components in the exhaust gas of an internal combustion engine. In particular, the proportion of nitrogen oxides in the exhaust gas can be reduced by the exhaust gas recycling feature. However, it is necessary to adjust and control the amount of exhaust gas fed to the internal combustion engine together with the quantity of fresh air supplied and together with the injected amount of fuel, for, with a thereby accomplished reduction of the nitrogen oxides in the exhaust gas, it is also possible to experience an increase in the soot, CO, and HC proportions.

The conventional control devices which ensure, with very low $NO_x$ emissions and with small HC emission, a long lifetime of the internal combustion engine are, however, in part very complicated and costly, since a large number of a great variety of control units, adjusting valves, servomotors, and the like is required.

Thus, a control device of a conventional type uses a hydraulic servomotor for controlling the throttle valve in the intake manifold, by means of which the amount of recycled exhaust gas can simultaneously be adjusted, since the throttle valve is positioned and constructed so that it operates, in its fully open position, simultaneously as a closing flap for the orifice of the exhaust gas recycling pipe. Accordingly, when the throttle valve is closed or almost closed, the inlet opening for the pipe which recycles the exhaust gases back to the intake manifold is fully open. The control of the throttle valve servomotor is effected via a valve in the controlled pressure chamber of a differential pressure valve, wherein the thus-controlled pressure chamber is connected with a metering cross section in the fuel supply line, regulated by a control slide valve. The position of the control slide valve is a function of a disk disposed in the intake manifold at right angles to the air flow direction. If the amount of fuel delivered by the injection pump is increased, a pressure increase occurs in the operating chamber of the servomotor via the differential pressure valve, and a corresponding opening of the throttle valve takes place until the state of equilibrium has been attained. There is the need for a simple, economical system, by means of which rather small vehicles can obtain sufficiently low exhaust gas emissions with less expenditure.

OBJECT AND SUMMARY OF THE INVENTION

The device of this invention for exhaust gas recycling has the advantage that the amount of recycled exhaust gas is controlled, in the zone (uncontrolled zone) wherein the deflection position of the control rod and/or the angle of the adjusting lever of the injection pump is, in an approximation, a measure for the quantity injected, by means of a simple linkage disposed between the adjusting lever and the throttle valve as the simultaneous closing element for the orifice of the exhaust gas return line. Such a control is sufficiently accurate and quite satisfactory for smaller vehicles, and sufficiently low exhaust gas emissions are obtained without any large expenditure.

In the zone wherein the controller associated with the fuel injection pump operates, i.e., in its adjusting range, no exhaust gas is recycled, and the orifice of the exhaust gas return line is closed by the fully opened throttle valve. This is done in a simple way by subjecting the servomotor which moves the throttle valve to the operating pressure of the fuel.

Thereby, smoking of the engine in the adjusting range of the controller is avoided.

Further advantageous further developments and improvements of the device are revealed hereinafter and finally claimed. It is particularly advantageous, for avoiding smoke puffs above the adjusting range, to close the orifice of the exhaust gas return line by the use of an accelerator member, which latter applies to the operating chamber of the servomotor for a short time a pressure surge of the pressure medium employed, namely of the available fuel.

DESCRIPTION OF THE EMBODIMENTS

Figure 1:
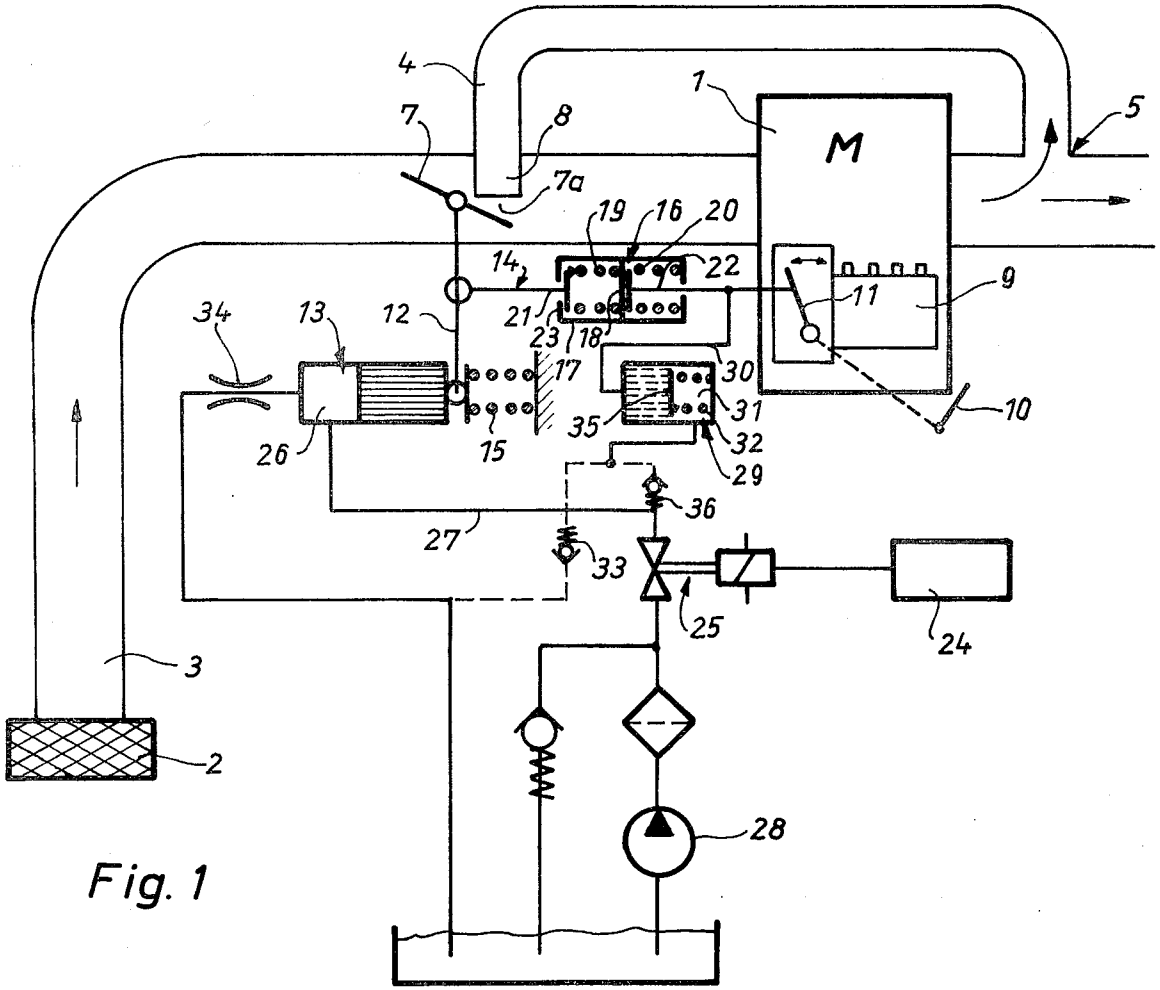
FIG. 1 schematically illustrates the correlation of the individual operating components with an internal combustion engine, and FIG. 2 diagrammatically illustrates the functional dependency of the throttle valve angle and thus of the exhaust gas recycling rate on the angle of the exhaust gas recycling rate on the angle of the adjusting lever of the injection pump.

Before explaining in detail, with reference to the drawings, the structure and mode of operation of the device of this invention for exhaust gas recycling, it is to be pointed out that the illustrated embodiment merely shows in a simplified form one possibility for controlling a fuel injection system in an internal combustion engine with controlled exhaust gas recycling, and can also be supplemented by any other desired structural components, relating, in particular, to the field of a controlled feeding of fuel.

The basic idea behind the present invention resides in the fact that a mechanical connection is established between the control rod of the fuel injection pump and the operating linkage of the throttle valve arranged in the intake manifold and simultaneously opening or closing the orifice of the exhaust gas return line.

In the drawings, the motor of the internal combustion engine is denoted by 1; by means of an intake manifold 3, provided with an air filter 2 at the inlet, the motor is fed with fresh air, and via the exhaust gas return line 4, a quantity of exhaust gas to be admixed to the fresh air proportion is likewise fed to the motor. The exhaust gas return line 4 branches off from the exhaust pipe 6 at 5 and terminates downstream in the zone of a throttle valve 7 in the intake manifold 3. The drawing shows a right-angled termination, so that the possibility can also be readily demonstrated that the exhaust gas return line 4, that terminates with a pipe section 8 into the intake manifold up to about the central line [line of symmetry] of the latter, can be closed off, in case of a fully opened position of the throttle valve 7 for the fresh air stream, by means of one half of the throttle valve, denoted by 7a, which is located downstream. By the pressure difference between the intake side and the exhaust side of the motor, which results from the volume enlargement in the motor, an exhaust gas return flow is ensured when the exhaust gas return line 4 is not closed off. It is to be readily understood that it is possible to provide a device for the charging of the internal combustion engine on the intake side, in addition to the increase in efficiency in the intake manifold after the exhaust gas return line has terminated therein.

The motor 1, in any event, is supplied with fuel from an injection pump illustrated at 9, having any desired construction (for example a series injection pump), wherein the injection pump can be mechanically actuated by an operating lever shown at 10, arbitrarily operable by the driver of the motor vehicle equipped with the motor 1. Customarily, the injection pump comprises a quantity regulating member coupled with the operating lever 10; this member can be the control rod of a series injection pump and is illustrated in the drawing as an adjusting lever 11. The adjusting lever 11 of the injection pump 9 changes its position from an idling position to a full throttle position. In general, a controller can be additionally associated with the fuel injection system area, which controller, as described hereinabove, determines the amount of air fed by the intake manifold 3 into the motor and sets a relationship between this amount and the quantity of fuel fed to the system, to obtain a specific air factor, and furthermore acts on the servomotor to position the throttle valve 7. This controller is not illustrated in the drawing, since it can be of any desired form and structure and in this sense is not considered to be an aspect of the present invention.

The invention is based on the realization that, in case of certain controller designs, for example in case of final idling controllers suitable for passenger cars, the angle of the adjusting lever, i.e., the position of the control rod denoted in the drawing by 11, can, in the uncontrolled range, be approximately a measure for the quantity injected, and it is thus possible to control the amount of recycled exhaust gas in dependence on the adjusting lever angle of the injection pump. To effect such control, the connecting linkage between the servomotor 13 for the throttle valve position and the throttle valve 7, which linkage is generally denoted by 12, is additionally connected mechanically with the adjusting lever 11, namely by the way of a connecting linkage 14 and preferably arranged to be resilient. It is to be also understood that the servomotor 13 can be acted upon, for throttle valve positioning, as an auxiliary measure also by the controller, but this point is not discussed in detail herein. The pretensioning of a spring 15 is furthermore effective on the linkage 12 for throttle valve actuation.

In order to realize a resilient connecting linkage 14, the latter comprises an excess-pressure spring mechanism 16 arranged in such a way that, in both adjustment directions, no rigid mechanical connection is provided, but rather, due to the design of certain springs, a functional dependency can be created between the angular position of the adjusting lever 11 and the angle of the throttle valve.

The excess-pressure spring mechanism comprises a housing 17 made bipartite by a partition 18. Pretensioned springs 19 and 20 are disposed in both of the thus-formed chambers, and these urge connecting levers 21 (from the throttle valve linkage 12) and 22 (from the adjusting lever 11) against stops 23 and 18 in the housing. The response areas for the adjusting distances can therefore be designed as desired by the stops and the points of attack of the springs at the connecting levers 21 and 22. Preferred curves for the functional dependency of the throttle valve angle on the adjusting lever angle can be seen from the diagrammatic representation in FIG. 2.

Figure 2:
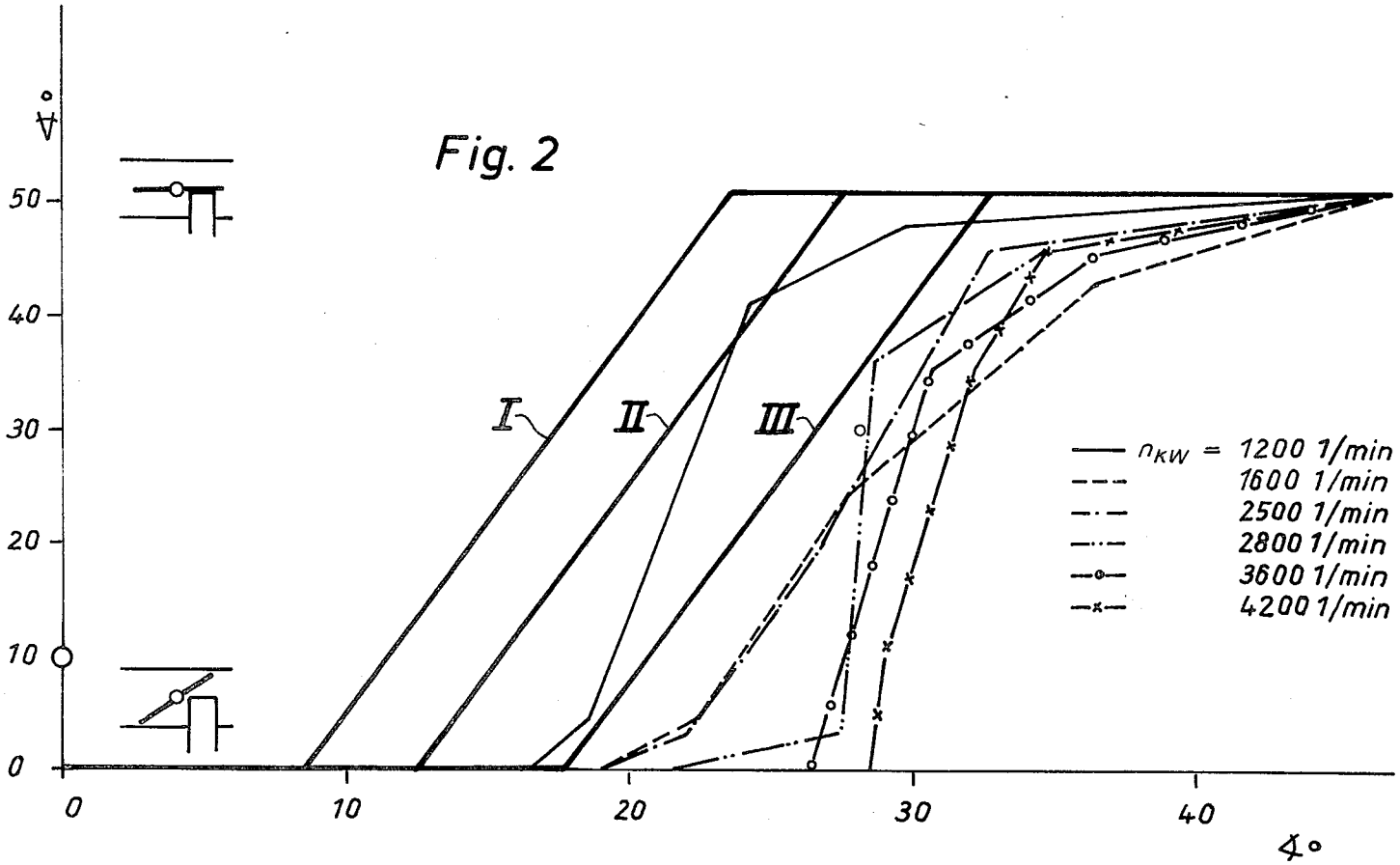

The diagram of FIG. 2 shows the throttle valve angle along the ordinate as a function of the adjusting lever angle plotted along the abscissa; three theoretically desirable curves for three different adjustments of the exhaust gas recycle control are shown in thick solid lines; the other curves show measured throttle valve angle positions and thus quantities of recycled exhaust gas plotted over the adjusting lever angle for various speeds of the internal combustion engine as the parameters. As indicated in FIG. 2, the curve shown in thin lines shows the functional dependency of the throttle valve angle on the adjusting lever angle for a crankshaft speed of revolution of 1200 $min^{-1}$; the curve in dot-dash lines is for a speed of revolution of 2500 $min^{-1}$; the dot-dash curve with two dots is for a speed of revolution of 2800 $min^{-1}$; the curve made up of dashes and circles is for a speed of revolution of 36 $min^{-1}$; and the curve consisting of dashes and crosses is for a speed of revolution of 4200 $min^{-1}$. The small drawings show, for the idling range lying at a throttle valve angle of 10°, an orifice for the exhaust gas return line vacated by the throttle valve and a throttle valve which is closed, whereas, at a throttle valve angle of 50°, the exhaust gas return line is closed and the throttle valve is fully opened.

Returning at this time to FIG. 1, no exhaust gas recycling is to take place in the adjusting range of the controller due to the fact that smoke would otherwise be emitted; therefore, a speed element 24 is provided which detects the speed range of the internal combustion engine wherein the adjusting range of the controller is located. The speed element 24, which can be of any desired design and shape, actuates a solenoid valve 25 associated therewith, the latter transmitting the full fuel pressure produced by the fuel pump 28 to the operating chamber 26 of the servomotor 13 for the throttle valve position, by way of a conduit 27. The throttle valve 7 is then placed, in the adjusting range of the controller, into the fully opened position and simultaneously closes the orifice of the exhaust gas return line completely.

Finally, to avoid a smoke puff above the adjusting range of the controller, an additional accelerator member 29 is provided which is likewise regulated by the adjusting lever 11 of the injection pump 9 by way of a mechanical connecting line indicated schematically at 30. The accelerator member 29 comprises an operating chamber 31, separated by means of a diaphragm or a piston 35 and a compression spring 32 for pretensioning the diaphragm or the piston 35, is arranged in this chamber. Via a throttle 34 and a check valve 33, the pressure medium (fuel) passes from the operating chamber 26 into the operating chamber 31 of the accelerator member 29; then, as soon as the operating chamber 31 is pressurized during a movement of the adjusting lever 11 in the direction "full" (acceleration), the pressure medium is fed via a check valve 36 and the conduit 27 to the operating chamber of the servomotor 26 and has the effect that the servomotor piston opens the throttle valve 7 against the force of spring 15 and/or closes the orifice of the exhaust gas return line 4.

What is claimed and desired to be secured by letters patent of the United States is:

1. Device for exhaust gas recycling in internal combustion engines equipped with a fuel injection system, including an injection pump, and having a throttle valve to control the recycled stream of exhaust gas arranged in the intake manifold, further wherein the throttle valve for an exhaust gas return line terminates in said intake manifold and is directly connected with an adjusting lever of said injection pump.

2. Device according to claim 1, further wherein a resilient means is disposed between said throttle valve and said adjusting lever.

3. Device according to claim 2, further wherein said resilient means includes an operating linkage associated with said throttle valve.

4. Device according to claim 2, further wherein said resilient means comprises a chamber including excess pressure springs, which are arranged to operate a lever system associated with said valve and said adjusting lever of said injection pump, whereby said throttle valve is arranged to close an orifice of said exhaust gas return line, and can be moved in accordance with a predetermined characteristic in dependence on the angle of said adjusting lever of said injection pump.

5. Device according to claim 3, further wherein said operating lever has a terminus connected to a servomotor, and a speed sensing means for feeding hydraulic pressure to said servomotor, wheereby said throttle valve can be opened and said gas return line closed.

6. Device according to claim 1, further wherein said adjusting lever includes an accelerator member arranged to operate said throttle valve through said servomotor.

7. Device according to claim 5, further wherein said servomotor is operated by an accelerator member.

8. Device according to claim 2, further wherein said adjusting lever includes an accelerator member.

9. Device according to claim 3, further wherein said operating linkage includes an accelerator member.

* * * * *